US005909728A

United States Patent [19]

Yoshioka et al.

[11] Patent Number: 5,909,728

[45] Date of Patent: Jun. 8, 1999

[54] AIR ASSIST DEVICE OF AN ENGINE

[75] Inventors: Mamoru Yoshioka; Yasuhiro Ooi, both of Susono, Japan

[73] Assignee: Toyota Jidosha Kabushiki Kaisha, Aichi-ken, Japan

[21] Appl. No.: 08/918,376

[22] Filed: Aug. 26, 1997

[30] Foreign Application Priority Data

Aug. 29, 1996 [JP] Japan ..... 8-228398

[51] Int. Cl.[6] ..... F02B 23/00

[52] U.S. Cl. ..... 123/585; 123/586

[58] Field of Search ..... 123/585, 586

[56] References Cited

U.S. PATENT DOCUMENTS

| | | | |
|---|---|---|---|
| 3,930,479 | 1/1976 | Stumpp | 123/585 |
| 4,015,568 | 4/1977 | Horiye et al. | 123/585 |
| 4,078,025 | 3/1978 | Kato | 123/585 |
| 4,366,779 | 1/1983 | Semence | 123/586 |
| 4,870,944 | 10/1989 | Matsumoto et al. | 123/585 |
| 4,966,122 | 10/1990 | Frinzel | 123/585 |
| 5,421,311 | 6/1995 | Wataya | 123/531 |
| 5,797,381 | 8/1998 | Yoshioka | 123/585 |
| 5,797,382 | 8/1998 | Yoshioka | 123/586 |

FOREIGN PATENT DOCUMENTS

| | | |
|---|---|---|
| 57-119139 | 7/1982 | Japan . |
| 6213107 | 8/1994 | Japan . |

*Primary Examiner*—Noah P. Kamen
*Assistant Examiner*—Jason Benton
*Attorney, Agent, or Firm*—Kenyon & Kenyon

[57] ABSTRACT

An air assist device comprising a slit shaped air intake formed in the inner wall of an intake duct around a throttle valve. The assist air is taken in from the air intake ports. A downstream side edge portion of the opening of the slip shaped air intake port is formed into an arc shape which extends along a downstream side edge portion of the outer peripheral end face of the throttle valve when the throttle valve is positioned at an idling position.

13 Claims, 5 Drawing Sheets

AIR ASSIST DEVICE OF AN ENGINE

BACKGROUND OF THE INVENTION

1. Field of the Invention

The present invention relates to an air assist device of an engine.

2. Description of the Related Art

To atomize the fuel injected from a fuel injector, use has conventionally been made of an air assist device which arranges the fuel injector in the intake passage downstream of the throttle valve, branches off an assist air passage from the intake passage upstream of the throttle valve, and blows the assist air ejected from an assist air ejection port of the assist air passage against the fuel injected from the fuel injector. As such an air assist device, there is known an air assist device wherein a narrow rectangularly shaped air intake port is formed in the circumferential direction in the inner wall of the engine intake passage so as to take in the assist air to be supplied to the fuel injected from the fuel injector and the area of the opening of a rectangular opening portion of the air intake port is controlled by the outer peripheral end face of the throttle valve (see Japanese Unexamined Patent Publication (Kokai) No. 6-213107).

In this air assist device, however, there is the problem that it is not possible to obtain the optimal amount of assist air for the operating state of the engine. That is, referring to FIGS. 10A and 10B showing the positional relationship between the throttle valve Y when at the idling position and the rectangularly shaped air intake port Z formed in the inner wall of the intake passage X, since a certain amount of assist air is required for idling operation, the part Z*a* of the air intake port Z has to be made to open at the upstream side of the throttle valve Y. FIG. 10A shows the optimal area Z*a* of the opening at this time.

On the other hand, a large amount of assist air becomes necessary as the throttle valve Y opens, the area Z*a* of the opening of the air intake port opening at the upstream side of the throttle valve Y is made to gradually increase as the throttle valve Y opens. Next, when the throttle valve Y further opens, the entire air intake port Z is made to open to the upstream side of the throttle valve Y. At this time, however, it is not possible to secure a sufficient amount of assist air with the area of the opening of the air intake port Z shown in FIG. 10A.

If, therefore, the length of the air intake port Z in the circumferential direction is increase as shown in FIG. 10B so that a sufficient amount of assist air is obtained when all of the air intake port Z opens to the upstream side of the throttle valve Y, the bottom edge portions Z*b* of the two ends of the air intake port Z will open to the downstream side of the throttle valve Y. If the air intake port Z opens to the downstream side of the throttle valve Y, the air flowing to the air intake port Z due to the large negative pressure caused at the downstream side of the throttle valve Y will be drawn to the downstream side of the throttle valve Y, so almost no assist air will flow. Therefore, the air intake port Z cannot be made to open to the downstream side of the throttle valve Y.

If, accordingly, the position of the air intake port Z shown in FIG. 10B is shifted to the upstream side so that the air intake port Z does not open to the downstream side of the throttle valve Y, the area Z*a* of the opening of the air intake port opening to the upstream side of the throttle valve Y during idling operation will end up becoming extremely large compared with the optimal value shown in FIG. 10A.

In this way, if the opening portion of the air intake port Z is formed in a rectangular shape, it will not be possible to secure the optimal amount of assist air for the engine operating state no matter how the dimensions, shape, or position of the air intake port Z are changed.

SUMMARY OF THE INVENTION

An object of the present invention is to provide an air assist device capable of obtaining an optimal amount of assist air.

According to the present invention, there is provided an air assist device of an engine having an intake passage and a fuel injector arranged in the intake passage, the device comprising an assist air passage for feeding assist air to fuel injected from the fuel injector; a throttle valve arranged in the intake passage upstream of the fuel injector and inclined with respect to a transverse plane of the intake passage when the throttle valve is positioned at an idling position; and at least one slit shaped air intake port connected to the assist air passage and formed on an inner wall of the intake passage so as to extend in the circumferential direction of the inner wall, an opening of the slit shaped air intake port being at least partially covered by an outer peripheral end face of the throttle valve when the throttle valve is positioned at an idling position, a downstream side edge portion of the opening of the slip shaped air intake port being formed into an arc shape which extends along a downstream side edge portion of the outer peripheral end face of the throttle valve when the throttle valve is positioned at an idling position, an amount of assist air fed into the assist air passage being controlled by the throttle valve.

BRIEF DESCRIPTION OF THE DRAWINGS

These and other objects and features of the present invention will become more apparent from the following description of the preferred embodiments given with reference to the attached drawings, in which.

DESCRIPTION OF THE PREFERRED EMBODIMENTS

Figure 1:
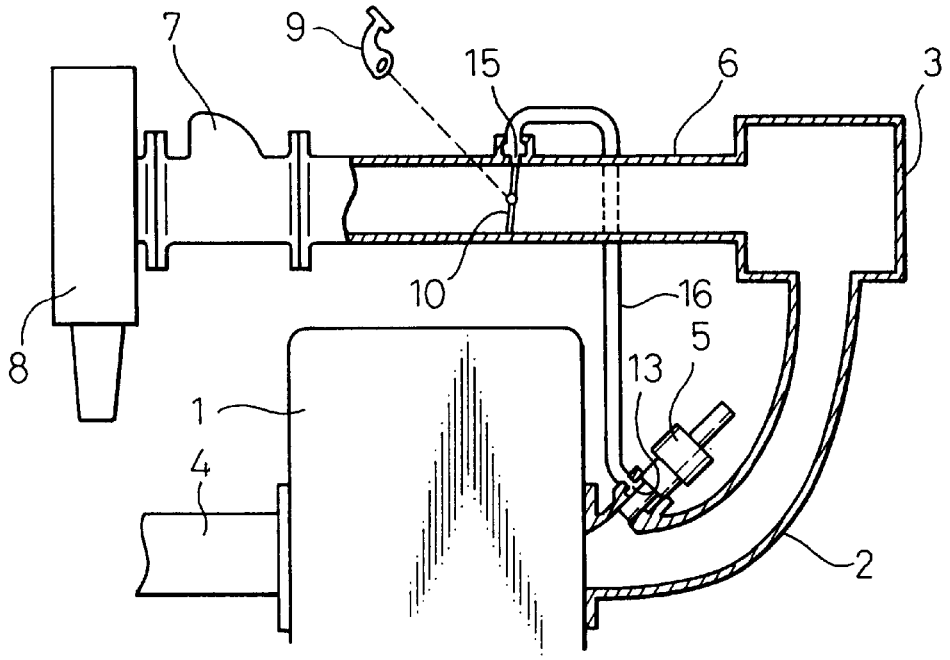
FIG. 1 is an overall view of an internal combustion engine.

Referring to FIG. 1, 1 is an engine body, 2 an intake tube, 3 a surge tank, and 4 an exhaust manifold. A fuel injector 5 is attached at each intake tube 2 to inject fuel into the intake port of the corresponding cylinder. The surge tank 3 is connected through an intake duct 6 and an air flow meter 7 to an air cleaner 8. A throttle valve 10 which can be controlled to open or close by an accelerator pedal 9 or motor is arranged inside the intake duct 6.

Figure 2:
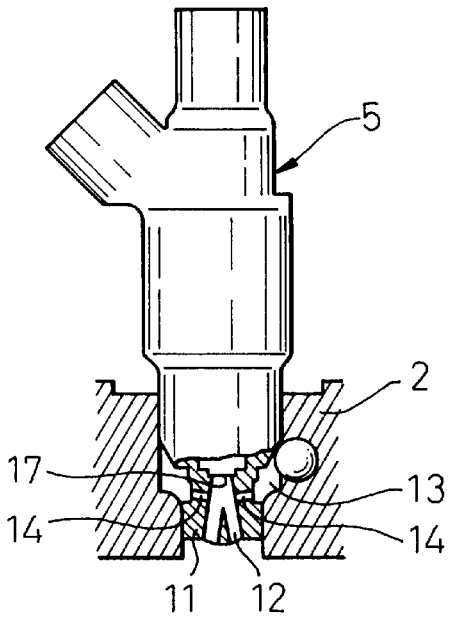
FIG. 2 is a partial sectional side view of an assist air type fuel injector.

As shown in FIG. 2, an assist air adapter 11 is attached to the front end of the fuel injector 5. The adapter 11 is provided with a fuel-air flow through hole 12 branched into two, an assist air chamber 13 formed around the adapter 11, and an assist air ejection port 14 opening inside the fuel-air flow through hole 12. On the other hand, as shown in FIG. 1, an air intake port 15 is formed in the inside wall of the intake duct 6 around the throttle valve 10. This air intake port 15 is connected through an assist air conduit 16 to the assist air chamber 13.

In the embodiment shown in FIG. 1, at least part of the air intake port 15 always opens inside the intake duct 6 upstream of the throttle valve 10. Therefore, the air inside the intake duct 6 upstream of the throttle valve 10 is fed by the difference between the pressure inside the intake duct 6 upstream of the throttle valve 10 and the pressure inside the intake tube 2 from the air intake port 15 through the assist air conduit 16 to the assist air chamber 13. Next, the air, that is, the assist air, is ejected from the assist air ejection port 14 to the inside of the fuel-air flow through hole 12. The fuel is ejected from the nozzle port 17 of the fuel injector 5 to the inside of the fuel-air flow through hole 12. The assist air ejected from the assist air ejection port 14 promotes the atomization of the injected fuel.

Figure 3:
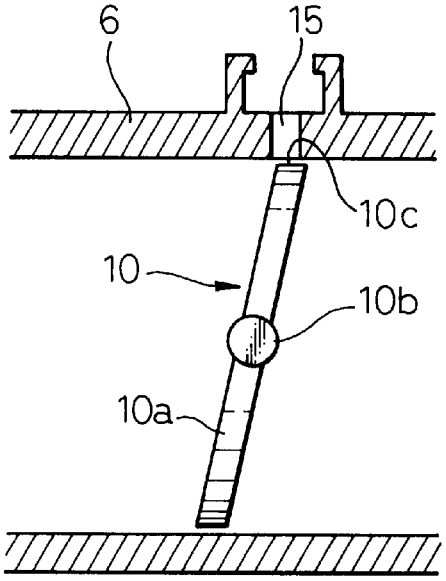
FIG. 3 is a side sectional view of the parts around the throttle valve of FIG. 1.
Figure 4:
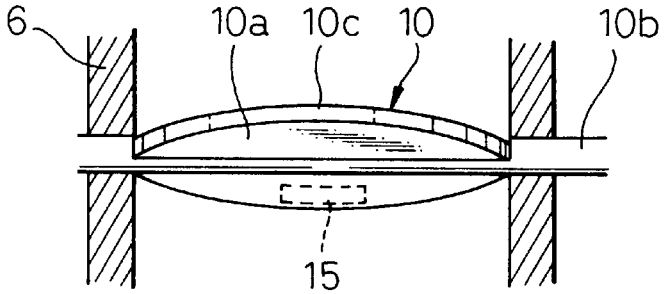
FIG. 4 is a sectional view of FIG. 3.

FIG. 3 and FIG. 4 are enlarged views of the parts around the throttle valve 10. As shown in FIG. 3 and FIG. 4, the inside wall of the intake duct 6 has a circular cross-section and the valve body 10*a* of the throttle valve 10 has a circular contour. The valve stem 10*b* of the throttle valve 10 extends substantially in the horizontal direction. An air intake port 15 extending in a slit shape toward the circumferential direction of the inside wall of the intake passage is formed in the inside wall of the intake duct 6 furthest away from the valve stem 10*b*. FIG. 3 and FIG. 4 show when the throttle valve 10 is in the idling position. At that time, it will be seen, the throttle valve 10 is inclined slightly with respect to the lateral cross-section of the intake passage inside the intake duct 6.

Figure 5:
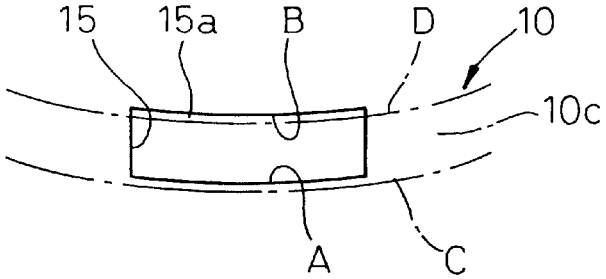
FIG. 5 is a view of the positional relationship between the valve body of the throttle valve and the air intake port.

FIG. 5 shows the positional relationship between the outer peripheral end face 10*c* of the throttle valve 10 and the air intake port 15 at the time when the throttle valve 10 is in the idling position as shown in FIG. 3 and FIG. 4. As will be understood from FIG. 5, in this embodiment, the downstream side edge portion A of the opening portion of the air intake port 15 is formed in an arc shape extending along the downstream side edge portion C of the outer peripheral end face 10*c* of the throttle valve 10 just slightly to the upstream side of the downstream side edge portion C of the outer peripheral end face 10*c* of the throttle valve 10. The upstream side edge portion B of the opening portion of the air intake port 15 is formed in an arc shape extending along the upstream side edge portion D of the outer peripheral end face 10*c* of the throttle valve 10 just slightly to the upstream side of the upstream side edge portion D of the outer peripheral end face 10*c* of the throttle valve 10. Therefore, when the throttle valve 10 is in the idling position, the downstream region of the opening portion of the air intake port 15 is completely covered by the outer peripheral end face 10*c* of the throttle valve 10 and just the upstream-most end region 15*a* of the opening portion of the air intake port 15 opens to the upstream side of the throttle valve 10 in a slit shape.

When the air intake passage 15 is formed to extend in an arc shape along the outer peripheral end face 10*c* of the throttle valve 10 at the idling position as shown in FIG. 5, by extending the length of the air intake port 15 in the longitudinal direction, it becomes possible to increase the amount of assist air when the entire air intake port 15 opens to the upstream side of the throttle valve 10 as much as desired. Further, by changing the shape or position of the upstream side edge portion B of the opening portion of the air intake port 15, it becomes possible to freely set the area of the upstream most end region 15*a* opening to the upstream side of the throttle valve 15 during idling operation. Therefore, it becomes possible to secure the optimal amount of assist air for the engine operating state.

FIGS. 6A to 6E show the positional relationships between the outer peripheral end face 10*c* of the throttle valve 10 and the air intake port 15 when the throttle valve 10 is in the idling position for various modifications of the air intake port 15. Note that even in the modifications shown in FIGS. 6A to 6E, the downstream side edge portion A of the opening portion of the air intake port 15 is formed in an arc shape extending along the downstream side edge portion C of the outer peripheral end face 10*c* of the throttle valve 10 at the idling position in the same way as in the embodiment shown in FIG. 5.

Figure 6A:
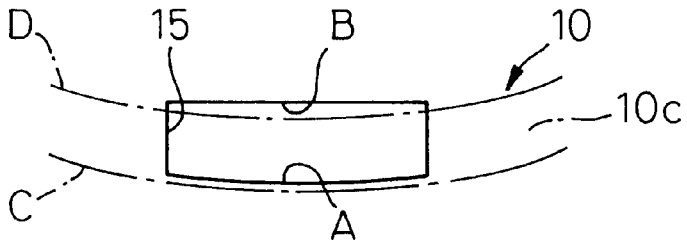
FIGS. 6A to 6E are views of various modifications of the air intake port.

In the example shown in FIG. 6A, the upstream side edge portion B of the opening portion of the air intake port 15 is formed in an arc shape projecting out toward the downstream side and having a larger radius of curvature than even the downstream side edge portion A, that is, is formed substantially straight in shape.

Figure 6B:
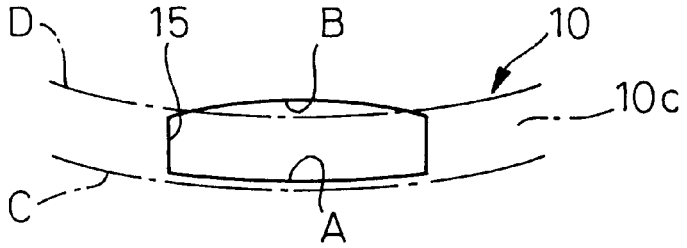

In the example shown in FIG. 6B, the upstream side edge portion B of the opening portion of the air intake port 15 is formed in an arc shape projecting out toward the upstream side.

Figure 6C:
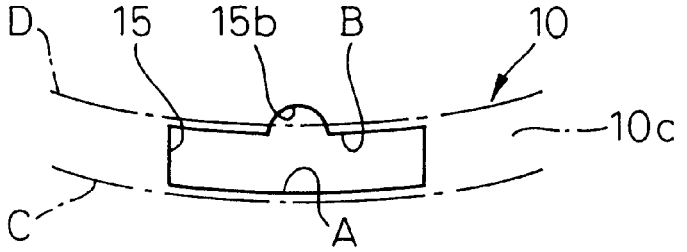

In the example shown in FIG. 6C, the air intake port 15 has a projecting opening portion 15*b* which projects out from the upstream side edge portion B and is positioned at the upstream side of the upstream side edge portion D of the outer peripheral end face 10*c* of the throttle valve 10. In the example shown in FIG. 6C, the projecting opening portion 15 forms a semicircle in shape. In this example, there is the advantage that the amount of assist air can be finely controlled when the throttle valve 10 is near the idling position.

Figure 6D:
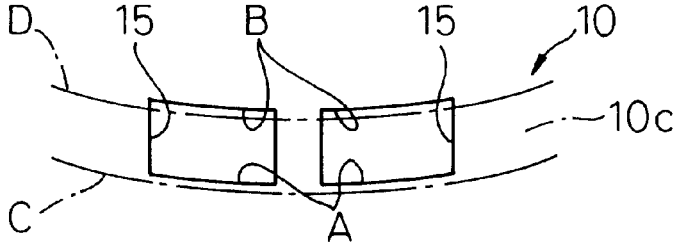

FIG. 6D shows the case where two air intake ports 15 in the positional relationship shown in FIG. 5 are provided. In this example, there is the advantage that it is possible to increase the rigidity of the intake duct 6 around the air intake port 15.

Figure 6E:
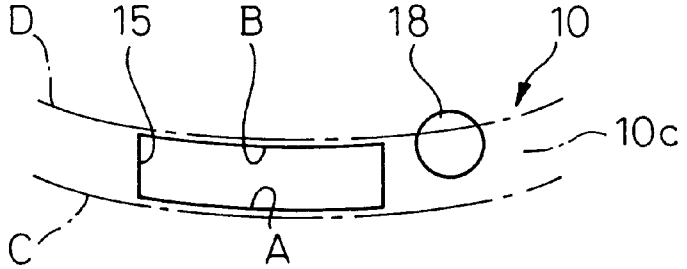

In the example shown in FIG. 6E, the air intake port 15 is completely covered by the outer peripheral end face 10*c* of the throttle valve 10 when the air intake port 15 is in the idling position and a separate circular shaped air intake port 18 opening at the upstream side of the throttle valve 10 at the time of idling operation is provided in addition to the air intake port 15.

Figure 7:
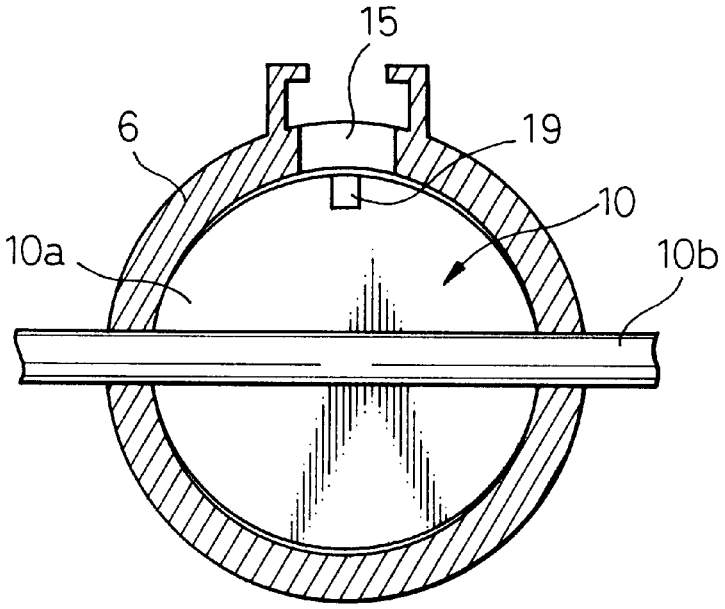
FIG. 7 is a sectional view of an intake duct showing still another modification.
Figure 8:
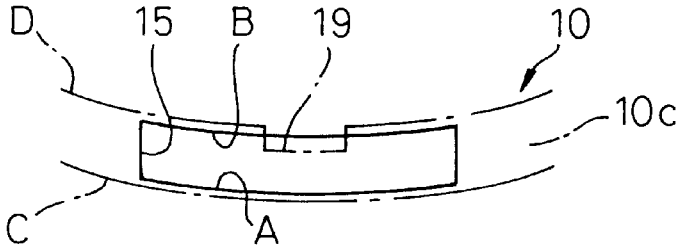
FIG. 8 is a view of the positional relationship between the air intake port shown in FIG. 7 and the valve body of the throttle valve.

FIG. 7 and FIG. 8 show still another modification. In this modification, as shown in FIG. 8 showing the positional relationship between the outer peripheral end face 10*c* of the throttle valve 10 in the idling position and the air intake port 15, the air intake port 15 is completely covered by the outer peripheral end face 10*c* of the throttle valve 10 when the throttle valve 10 is at the idling position. Further, in this embodiment, an air intake groove 19 which opens to the upstream end region of the opening portion of the air intake port 15 when the throttle valve is at the idling position is formed at the upstream side surface peripheral edge of the valve body 10*a* of the throttle valve 10.

Figure 9:
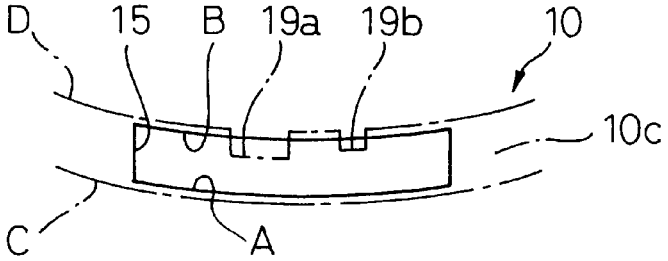
FIG. 9 is a view of a modification of FIG. 8.
Figure 10A:
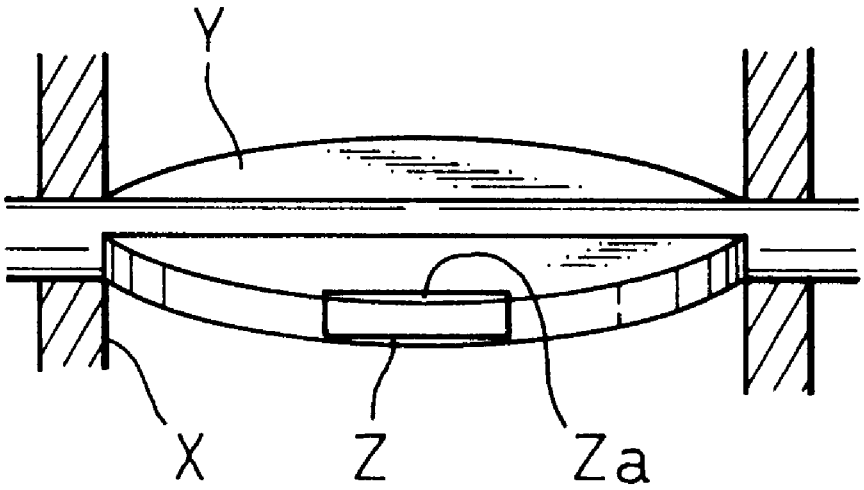
FIGS. 10A and 10B are views for explaining the relationship between the throttle valve and the air intake port.
Figure 10B:
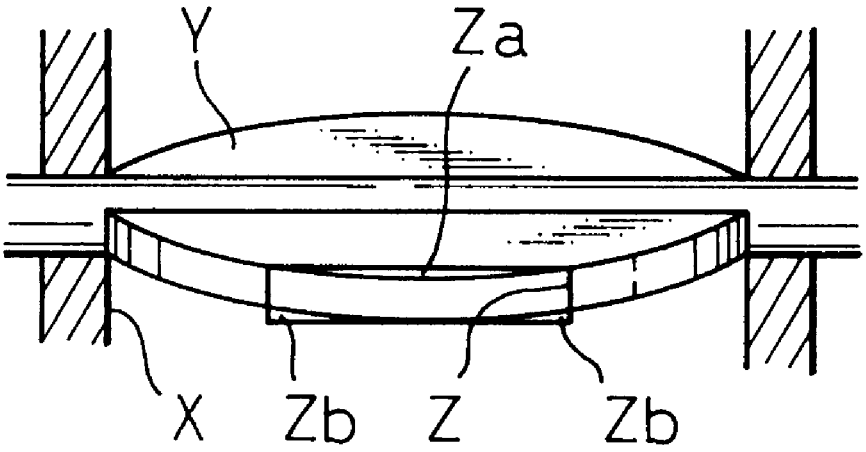

FIG. 9 shows a modification of FIG. 8. In the modification shown in FIG. 9, the air intake groove formed at the upstream side surface peripheral edge of the valve body 10*a* of the throttle valve 10 is comprised of an air intake groove 19*a* with a large cross-sectional area and an air intake groove 19*b* with a small cross-sectional area.

As explained above, according to the present invention, it is possible to obtain the optimal amount of assist air for the operating state of the engine when controlling the area of the opening of the air intake port by a throttle valve.

While the invention has been described by reference to specific embodiments chosen for purposes of illustration, it should be apparent that numerous modifications could be made thereto by those skilled in the art without departing from the basic concept and scope of the invention.

We claim:

1. An air assist device of an engine having an intake passage and a fuel injector arranged in the intake passage, said device comprising:

an assist air passage for feeding assist air to fuel injected from the fuel injector;

a throttle valve arranged in the intake passage upstream of the fuel injector and inclined with respect to a transverse plane of the intake passage when the throttle valve is positioned at an idling position; and at least one slit shaped air intake port connected to said assist air passage and formed on an inner wall of the intake passage so as to extend in the circumferential direction of said inner wall, an opening of said slit shaped air intake port being at least partially covered by an outer peripheral end face of the throttle valve when the throttle valve is positioned at an idling position, a downstream side edge portion of the opening of said slit shaped air intake port being formed into an arc shape which extends along a downstream side edge portion of the outer peripheral end face of the throttle valve when the throttle valve is positioned at an idling position, an amount of assist air fed into said assist air passage being controlled by said throttle valve.

2. An air assist device as set forth in claim 1, wherein when the throttle valve is at the idling position, a portion of the opening of said slit shaped air intake port opens inside the intake passage upstream of the throttle valve and the remaining portion of the opening of said slit shaped air intake port is covered by the outer peripheral end face of the throttle valve and, when the throttle valve is opened, the entire opening of said slit shaped air intake port opens inside the intake passage upstream of the throttle valve.

3. An air assist device as set forth in claim 1, wherein said slit-shaped air intake port is formed in the inner wall of the intake passage at a position furthest away from the throttle axis.

4. An air assist device as set forth in claim 1, wherein an arc-shaped downstream side edge portion of said slit shaped air intake port is positioned just a little to the upstream side of the downstream side edge portion of the outer peripheral end face of the throttle valve when the throttle valve is at the idling position.

5. An air assist device as set forth in claim 1, wherein the upstream side edge portion of the opening of said slit shaped air intake port is formed in an arc shape extending along the upstream side edge portion of the outer peripheral end face of the throttle valve when the throttle valve is in the idling position.

6. An air assist device as set forth in claim 1, wherein the upstream side edge portion of the opening of said slit shaped air intake port is formed substantially straight in shape.

7. An air assist device as set forth in claim 1, wherein the upstream side edge portion of the opening of said slit shaped air intake port is formed in a curved shape projecting out toward the upstream side.

8. An air assist device as set forth in claim 1, wherein the opening of said slit shaped air intake port is provided with a projecting opening portion which projects out toward the upstream side from the upstream side edge portion of said air intake port and which is positioned at the upstream side of the upstream side edge portion of the outer peripheral end face of the throttle valve when the throttle valve is in the idling position.

9. An air assist device as set forth in claim 8, wherein said projecting opening portion forms a semicircular shape.

10. An air assist device as set forth in claim 1, wherein a pair of slit shaped air intake ports are provided and arranged symmetrically with respect to a plane passing through the center of the throttle valve and perpendicular to an axis of the throttle valve.

11. An air assist device as set forth in claim 1, wherein, in addition to said slit shaped air intake port, a circular shaped air intake port is formed in the inner wall of the intake passage, the opening of said slit shaped air intake port is covered by the outer peripheral end face of the throttle valve when the throttle valve is at the idling position, and a portion of the opening of said circular shaped air intake port opens into the intake passage upstream of the throttle valve and the remaining opening portion of said circular shaped air intake port is covered by the outer peripheral end face of the throttle valve when the throttle valve is at the idling position.

12. An air assist device as set forth in claim 1, wherein at least one air intake groove which opens inside the opening of said slit shaped air intake port when the throttle valve is at the idling position is formed at the peripheral edge of a surface of a valve body at the upstream side of the throttle valve.

13. An air assist device as set forth in claim 12, wherein said air intake groove is comprised of a first groove and a second groove with a cross-sectional area smaller than said first groove.

* * * * *